US006178694B1

(12) United States Patent
Wagnitz

(10) Patent No.: US 6,178,694 B1
(45) Date of Patent: Jan. 30, 2001

(54) WALK-THROUGH GATE WITH CONCEALED HINGE AND LATCH

(75) Inventor: Kurt P. Wagnitz, Green Bay, WI (US)

(73) Assignee: Evenflo Company, Inc., Vandalia, OH (US)

( * ) Notice: Under 35 U.S.C. 154(b), the term of this patent shall be extended for 0 days.

(21) Appl. No.: 09/177,398

(22) Filed: Oct. 23, 1998

(51) Int. Cl.[7] ..... E06B 3/68
(52) U.S. Cl. ..... 49/55; 49/57; 160/225
(58) Field of Search ..... 49/50, 55, 57, 49/380, 463, 465, 394, 395, 181, 182, 183, 503; 160/211, 216, 221, 222, 223, 225, 228, 206, 199; 16/235, 242, 245, 246; 52/184, 185; 292/300, 302, 37, 41, 48, 49

(56) References Cited

U.S. PATENT DOCUMENTS

| | | | | |
|---|---|---|---|---|
| 128,582 | | 7/1872 | Boughton . | |
| 151,599 | | 6/1874 | Kells . | |
| 179,386 | * | 6/1876 | Yates | 160/228 |
| 193,573 | | 7/1877 | Tripp . | |

(List continued on next page.)

FOREIGN PATENT DOCUMENTS

| | | |
|---|---|---|
| 23 57 660 A1 | 11/1973 | (DE) . |
| 651926 | 4/1951 | (GB) . |
| 2 058 186 | 4/1981 | (GB) . |
| 2 214 551 | 9/1989 | (GB) . |
| 2 234 283 | 1/1991 | (GB) . |
| WO 93/07352 | 4/1993 | (WO) . |
| WO 94/00664 | 1/1994 | (WO) . |

*Primary Examiner*—Daniel P. Stodola
*Assistant Examiner*—Curtis A. Cohen
(74) *Attorney, Agent, or Firm*—Thompson Hine & Flory LLP

(57) ABSTRACT

A two section gate assembly restricts access through a wall opening. The two gate sections overlap as determined by the wall opening size. A vertical hinge rail in one gate section forms a hinge side, and a vertical latch rail in the other gate section forms a latch side. A concealed vertical edge of the hinge rail includes two horizontally spaced swing bolts that are adjusted to compensate for a hinge wall that is not perpendicular. The two swing bolts and two wall mounted hinge pin brackets are covered by decorative hinge covers. A concealed vertical edge of the latch rail includes two horizontally spaced latch tabs that are spring biased downward. Upon swinging the gate assembly to a closed position, the latch tabs encounter wall mounted latch receivers having an upward extending ramp, whereupon the latch tabs are forced to move upward against their spring bias. When the gate assembly is fully closed, the latch tabs drop vertically downward into latch recesses. The edge of the latch rail includes an upward movable latch pull. Upward movement of the latch pull unlatches the gate assembly from the latch receivers. The top rails of the two gate sections have a decorative banister shaped outer surface, and have internally facing surfaces with horizontally directed interlocking shapes.

19 Claims, 7 Drawing Sheets

U.S. PATENT DOCUMENTS

| | | | | |
|---|---|---|---|---|
| 260,679 | | 7/1882 | Harley . | |
| 280,614 | | 7/1883 | Harley . | |
| 281,964 | | 7/1883 | Brent . | |
| 295,163 | | 3/1884 | Grove . | |
| 311,044 | | 1/1885 | Tarney . | |
| D. 341,207 | | 11/1993 | Freese et al. . | |
| 351,502 | | 10/1886 | Dougherty . | |
| 376,436 | | 1/1888 | Harrison . | |
| 388,653 | * | 8/1888 | England | 49/394 |
| 457,639 | | 8/1891 | Doenitz . | |
| 470,350 | | 3/1892 | Nunn . | |
| 471,467 | | 3/1892 | Crisson . | |
| 482,811 | * | 9/1892 | Roebuck | 160/228 |
| 546,909 | | 9/1895 | Spencer . | |
| 646,120 | | 3/1900 | Gallaher . | |
| 683,307 | * | 9/1901 | Linck | 160/225 |
| 700,362 | | 5/1902 | Niehaus . | |
| 746,403 | | 12/1903 | Tarney . | |
| 832,335 | | 10/1906 | McDonald . | |
| 855,769 | | 6/1907 | Grant . | |
| 973,049 | * | 10/1910 | Jones | 292/48 |
| 975,470 | | 11/1910 | Shrady . | |
| 1,175,109 | | 3/1916 | Anderson . | |
| 1,295,712 | | 2/1919 | Drew . | |
| 1,325,519 | | 12/1919 | Jenkins . | |
| 1,356,479 | * | 10/1920 | Werner | 292/48 |
| 1,393,405 | | 10/1921 | Soteros et al. . | |
| 1,438,202 | | 12/1922 | Wieland . | |
| 1,450,920 | | 4/1923 | Hutchinson . | |
| 1,469,525 | | 10/1923 | Nadolney . | |
| 1,497,849 | | 6/1924 | Hart . | |
| 1,519,908 | | 12/1924 | Etue . | |
| 1,525,926 | | 2/1925 | Eutin . | |
| 1,529,085 | * | 3/1925 | Preble | 292/48 |
| 1,532,769 | | 4/1925 | McElroy . | |
| 1,608,667 | | 11/1926 | Poetsch . | |
| 1,662,586 | | 3/1928 | Newman . | |
| 1,729,039 | * | 9/1929 | French | 49/503 |
| 1,740,827 | * | 12/1929 | Mayea | 292/48 |
| 1,908,989 | | 5/1933 | Lahey et al. . | |
| 1,958,695 | | 5/1934 | Claus . | |
| 1,964,332 | | 6/1934 | Rembaum . | |
| 2,099,068 | | 11/1937 | Keithly . | |
| 2,225,963 | | 12/1940 | Augustine . | |
| 2,357,819 | | 9/1944 | Greer . | |
| 2,577,034 | * | 12/1951 | Quinlan | 160/225 |
| 2,624,402 | | 1/1953 | Lukasavicz . | |
| 2,793,050 | | 5/1957 | Cook . | |
| 2,851,746 | | 9/1958 | McPhaden . | |
| 2,982,353 | * | 5/1961 | Luger | 160/225 |
| 3,000,063 | | 9/1961 | Hoog . | |
| 3,346,289 | | 10/1967 | Anderson . | |
| 3,454,075 | | 7/1969 | Weinstein . | |
| 3,511,300 | * | 5/1970 | Matyas | 160/206 |
| 3,583,466 | | 6/1971 | Dreyer . | |
| 3,636,683 | | 1/1972 | Francis et al. . | |
| 3,774,958 | | 11/1973 | Thorpe . | |
| 3,800,714 | | 4/1974 | Stark et al. . | |
| 3,812,616 | | 5/1974 | Koziol . | |
| 3,978,619 | | 9/1976 | Gregoire | 49/504 |
| 4,064,590 | * | 12/1977 | Smith | 160/206 |
| 4,103,445 | | 8/1978 | Smith et al. . | |
| 4,124,322 | | 11/1978 | Parisien . | |
| 4,139,249 | | 2/1979 | Hillman . | |
| 4,345,862 | * | 8/1982 | Blout et al. | 49/503 |
| 4,377,303 | | 3/1983 | McPherson . | |
| 4,431,331 | | 2/1984 | Brody . | |
| 4,482,023 | | 11/1984 | Dziedzic et al. . | |
| 4,492,263 | | 1/1985 | Gebhard . | |
| 4,583,715 | | 4/1986 | Wright . | |
| 4,607,455 | | 8/1986 | Bluem et al. . | |
| 4,611,431 | | 9/1986 | Lauro . | |
| 4,628,635 | | 12/1986 | Maillard . | |
| 4,677,789 | * | 7/1987 | Merry | 49/395 |
| 4,677,791 | | 7/1987 | Larson et al. . | |
| 4,685,247 | | 8/1987 | Alam . | |
| 4,777,765 | * | 10/1988 | Johnson, Jr. | 49/55 |
| 4,787,174 | | 11/1988 | Brown . | |
| 4,825,921 | | 5/1989 | Rigter . | |
| 4,831,777 | | 5/1989 | Johnson, Jr. . | |
| 4,846,246 | | 7/1989 | Stern . | |
| 4,884,614 | | 12/1989 | Spurling . | |
| 4,944,117 | | 7/1990 | Gebhard et al. . | |
| 4,999,949 | * | 3/1991 | Granlund | 49/503 |
| 5,018,302 | | 5/1991 | Kluge . | |
| 5,052,461 | * | 10/1991 | Stern | 160/216 |
| 5,060,421 | | 10/1991 | Castelli . | |
| 5,113,611 | | 5/1992 | Rosson . | |
| 5,117,585 | * | 6/1992 | Andrisin, III | 49/55 |
| 5,134,806 | | 8/1992 | Bukart, Jr. . | |
| 5,207,260 | | 5/1993 | Commesso . | |
| 5,217,265 | | 6/1993 | Lerner et al. . | |
| 5,272,840 | | 12/1993 | Knoedler et al. . | |
| 5,293,656 | | 3/1994 | Chan . | |
| 5,294,167 | | 3/1994 | Yu . | |
| 5,367,829 | | 11/1994 | Crossley et al. . | |
| 5,437,115 | | 8/1995 | Freese et al. . | |
| 5,442,881 | | 8/1995 | Asbach et al. . | |
| 5,452,544 | * | 9/1995 | Weathington, Sr. | 49/394 |
| 5,505,244 | | 4/1996 | Thumann . | |
| 5,524,944 | | 6/1996 | Berg . | |
| 5,531,258 | | 7/1996 | Poulson et al. . | |
| 5,533,214 | | 7/1996 | Graham . | |
| 5,533,715 | | 7/1996 | Dandrea . | |
| 5,549,347 | | 8/1996 | Anderson . | |
| 5,636,679 | | 6/1997 | Miller et al. . | |
| 5,638,885 | | 6/1997 | Freese et al. . | |
| 5,690,317 | | 11/1997 | Sandsborg . | |
| 5,906,069 | * | 5/1999 | Berliner | 49/55 |
| 5,924,242 | * | 7/1999 | Macari et al. | 49/463 |
| 6,016,629 | * | 1/2000 | Sylvester et al. | 49/394 |
| 6,073,396 | * | 6/2000 | Kietzman | 49/381 |

* cited by examiner

WALK-THROUGH GATE WITH CONCEALED HINGE AND LATCH

BACKGROUND OF THE INVENTION

1. Field of the Invention

This invention relates to a walk-through gate, and more specifically to a walk-through gate having two gate-sections that are user overlapped and then secured together to form a hinged and latched gate-assembly that will span an opening of a given width.

2. Description of the Related Art

It is well-known to provide safety gates for wall openings, doorways, stair wells, or staircases, in order to prevent the passage therethrough of small children, infants, or pets.

One common type of safety gate includes gate sections that can be expanded sufficiently to place friction pads into frictional engagement with the vertical surfaces or walls that define such an opening that is to be closed by the safety gate. Safety gates of this type have several disadvantages. First, the expanded gate sections sometimes may not be adjusted properly by the user, and thus may not provide a tight fit with the opening walls. In this case, the gate is not sturdily attached to the walls, and can be easily pushed over or otherwise defeated by a child or pet.

Also, many gates of this type do not work well when the two opposing walls are not truly vertical, a situation that is not uncommon. In this case, the upper or the lower portion of the gate may make better frictional contact with the walls than does the other gate portion, causing a situation in which the safety gate can be easily defeated.

Even if a safety gate of this type is properly adjusted to make very tight frictional contact with the two opposed walls, paint, wallpaper, or another finish on the two walls may be damaged by the friction pads. Lastly, it may be inconvenient to repeatedly disconnect and reconnect the compressed safety gate sections when passage through the gate is required.

Another class of safety gate typically includes the more permanent mounting of one side of the gate to one opposed wall, and some type of latching, or locking, of the other side of the gate to the opposite wall. Typically, the latch/lock may include a mechanism, such as a hook and eye combination, or some other manually releasable mechanism. Gates of this type also have inherent drawbacks. First, the latch/lock mechanism are sometimes not adequately secure, and may sometimes be easily defeated by a child or pet. Second, these gates may not be easily removable from a doorway or staircase at those times during which it is not desirable to have the gate in place.

The art has also generally failed to provide safety gates that have a low manufacturing cost, that have high utility, that are easy for a user to assemble and operate, that are of a high furniture-quality, that can be tailored to blend with any of a variety of furniture periods, and that are aesthetically pleasing to the user.

It is against this background, and with the desire to solve problems of the above type that are found in the prior art, that the present invention was developed.

SUMMARY OF THE INVENTION

This invention provides a walk-through gate assembly whose plural gate sections are user overlapped in the horizontal direction to an extent that is required to span a given wall opening.

Most desirably, the present invention provides a new and unusual construction and arrangement whereby such a gate assembly is not only easy to assemble, but in addition, when assembled, the user of the gate assembly can easily attach the gate assembly to a pivot wall, for cooperation with an adjacent latch wall.

In embodiments of the invention to be described, the gate assembly is generally rectangular in shape, having a fixed and relatively short vertical dimension, and having a user selected and relatively long horizontal dimension that varies in accordance with the size of the wall opening that the user desires to selectively close by use of the pivoted gate assembly.

In an embodiment of the invention, the gate assembly is formed by two similar dimension, rectangular, and planar shaped gate sections. Prior to use, the user positions these two gate sections in overlapping fashion. The user then uses a plurality of metal brackets to secure the overlapped portions of the gate sections, to thereby form a unitary gate assembly.

The concealed hinge edge of the gate assembly carries two swing blots that are user adjusted to compensate for any non-perpendicularity of the hinge wall. Once the swing bolts are adjusted, and the hinge end of the gate assembly is mounted on pivot brackets that are mounted on the hinge wall, a decorative hinge cover is attached to the pivot bracket and the hinge wall.

The concealed latch end of the gate assembly carries two upward movable latch tabs that mate with two latch receivers that are mounted in mating positions on the latch wall. An extension spring is provided in the latch assembly to force bias the two latch tabs downward. Each latch receiver includes an upwardly extending ramp, or sloped surface, that forces the latch tabs upward as the gate assembly is closed. When the gate assembly reaches its closed position, the latch tabs drop downward into latch recesses.

When it is desired to open the gate assembly, a latch pull is moved upward, thus pulling the latch tabs upward against their spring bias, and out of the latch recesses.

Each of the two gate sections include a linear and horizontally extending top rail half. These two top rail halves include interlocking inner surfaces. When assembled by the user, the two top rail halves form an interlocked top rail having the aesthetically pleasing shape of a furniture like banister.

It is a general object of this invention to provide a new and improved walk-through gate assembly.

It is another object of this invention to provide a horizontally extending gate assembly that can be quickly and easily assembled by a user, and then securely pivoted to one of a pair of opposed vertical surfaces that are horizontally spaced apart by an opening distance.

It is also an object of this invention to provide a gate assembly which when installed, can easily be pivoted in and out of a latched position relative to the latch wall, and in which this pivoting movement can be selectively restricted to a particular direction of movement.

It is further an object of this invention to provide a gate assembly whose hinges are decoratively concealed from view, and in which the gate assembly's latch mechanism can be easily operated by an adult, but is concealed from view within the latch side of the gate assembly.

It is still further an object of this invention to provide a gate assembly with the above advantages that is aesthetically pleasing, as well as easily manufactured and assembled.

A more specific object of the invention is to provide a two section gate assembly for use in restricting access through a wall opening, wherein two gate sections overlap as determined by the wall opening size, wherein a vertical hinge rail in one gate section forms a hinge side, wherein a vertical latch rail in the other gate section forms a latch side, wherein a concealed vertical edge of the hinge rail includes two horizontally spaced swing bolts that are horizontally adjusted to compensate for a hinge wall not being perpendicular, wherein the two adjusted swing bolts and two wall mounted hinge pins are covered by decorative hinge covers, wherein a concealed vertical edge of the latch rail includes two horizontally spaced latch tabs that are spring biased downward, such that upon swinging the gate assembly to a closed position the latch tabs encounter wall mounted latch receivers having an upward extending ramp, whereupon the latch tabs are forced to move upward against their spring bias, and such that when the gate assembly is fully closed, the latch tabs drop vertically downward into a latch recess, wherein the edge of the latch rail includes an upward movable latch pull such that upward movement of the latch pull unlatches the gate assembly from the latch receivers, and wherein the top rails of the two gate sections have internally facing surfaces with interlocking shapes, and have external surfaces that blend to form the shape of a banister.

Additional objects, advantages and novel features of this invention are set forth in the detailed description that follows. Other objects and advantages will become apparent to those skilled in the art upon examining this detailed description, and will also be learned by the practice of this invention. The objects and advantages of this invention may be realized and attained by means of the instrumentalities, combinations, and methods particularly pointed out in the appended claims.

BRIEF DESCRIPTION OF THE DRAWINGS

The accompanying drawings, which are incorporated in and form a part of the specification, illustrate preferred embodiments of the invention, and together with the detailed description serve to explain the principles of the invention.

DESCRIPTION OF THE PREFERRED EMBODIMENT

Figure 1:
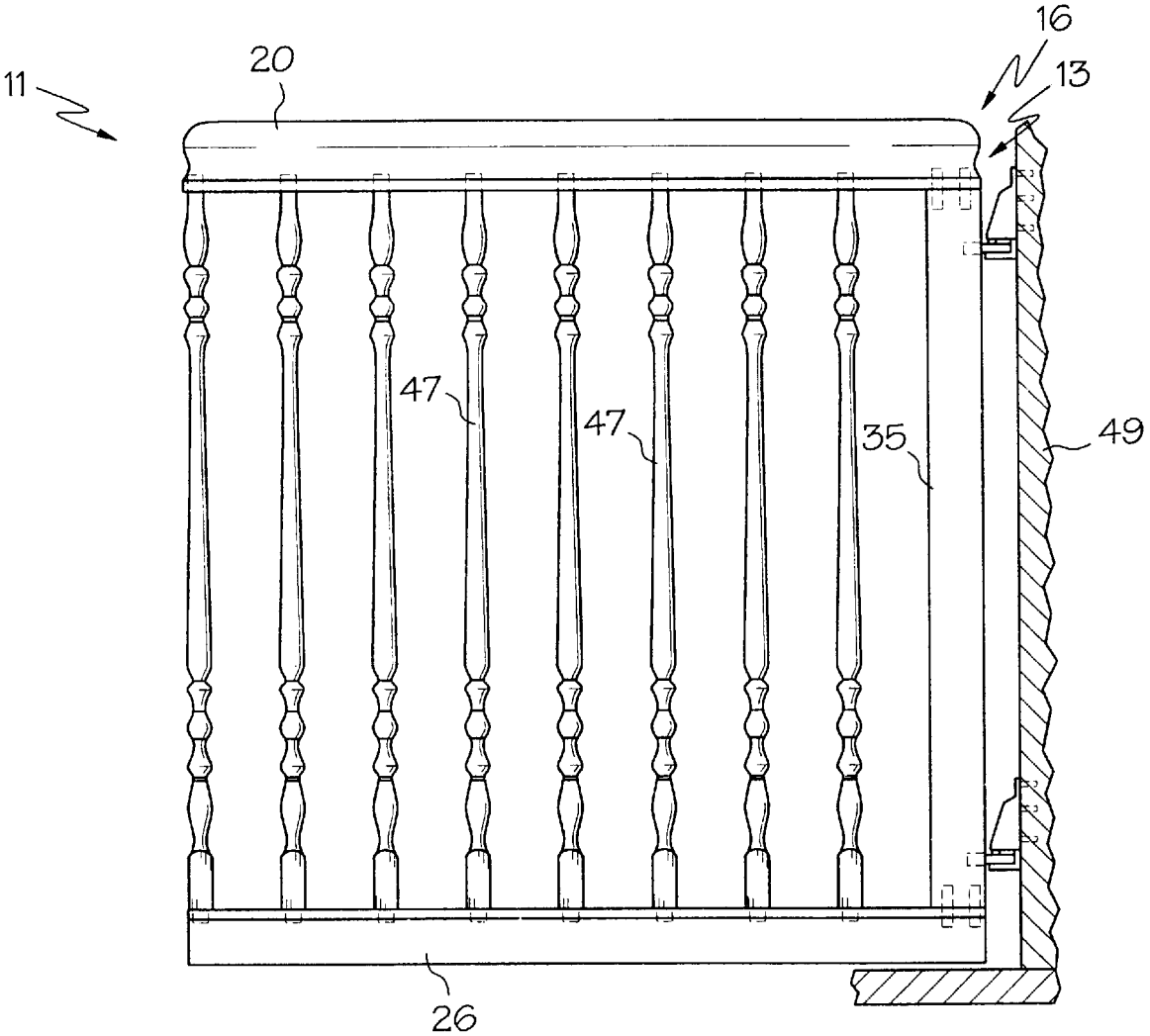
FIG. 1 is a mating surface view, or inside surface view, of a first gate section, or hinge gate section, in accordance with this invention, this first gate section having a vertically-extending hinge rail located at the right side thereof, and this figure also showing a portion of a hinge wall and floor that define an opening to be closed by the gate assembly of the invention.
Figure 2:
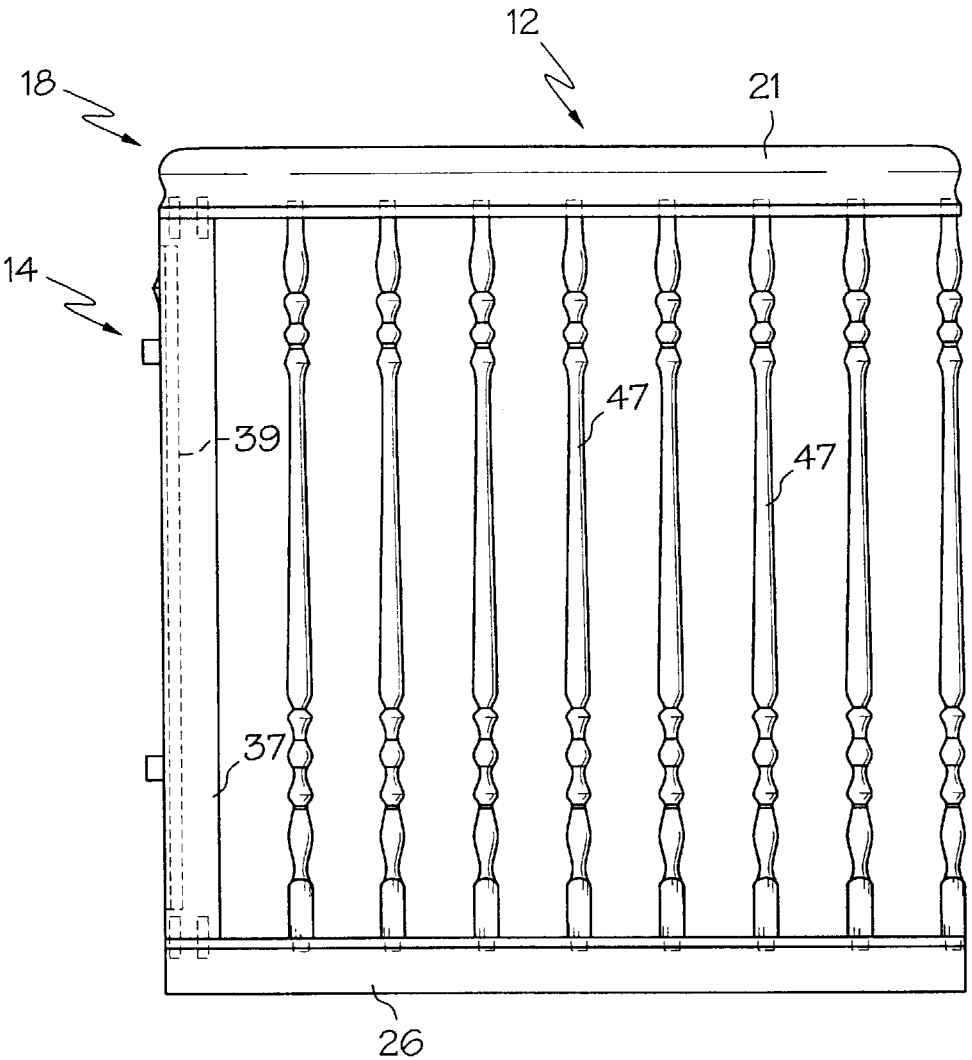
FIG. 2 is an outer surface view of a second gate section, or latch gate section, in accordance with his invention, this second gate section having a vertically extending latch rail located at the left side thereof, and this figure showing by way of dotted line a latch cavity that is formed in the concealed vertical wall side edge of the latch rail, this cavity operating to receive and house a major portion of the gate assembly's latch assembly.

With reference to all of the drawing figures, this invention provides a walk through gate assembly 10 having two gate sections 11/12 that are to be user overlapped in the horizontal direction, and then physically secured together to form a unitary gate assembly 10, for use in spanning an opening of a predetermined size. Most desirably, the present invention provides a new and unusual construction and arrangement, whereby such a two section gate assembly 10 is not only easy to size adjust and then relatively permanently secure together (that is, the user may wish to later reassemble gate assembly 10 to close a different size opening), but in addition, when extended, walk through gate assembly 10 is aesthetically pleasing to the eye and does not sag or droop downward.

Preferred embodiments of the invention to be described relate to a pivoted and latched walk through gate assembly 10 having a new and unusual hidden hinge assembly 13 and a new and unusual hidden latch assembly 14, both of which are aesthetically pleasing to the eye. In embodiments of the invention to be described, but without limitation thereto, gate assembly 10 is generally rectangular in shape, such that it is horizontally longer than it is vertically high.

In an embodiment of the invention, gate assembly 10 is formed by two similar dimension, rectangular, and horizontally planar gate sections 11/12. The two gate sections 11/12 are longitudinally positionable relative to one another by the user. The user then mounts the two gate sections 11/12 at this fixed and partially overlapping position, and in a side plane abutting relationship, such that at the center portion of gate assembly 10 the two gate sections 11/12 physically overlap by an amount that is determined by the size of the opening to be closed by gate assembly 10.

Figure 8:
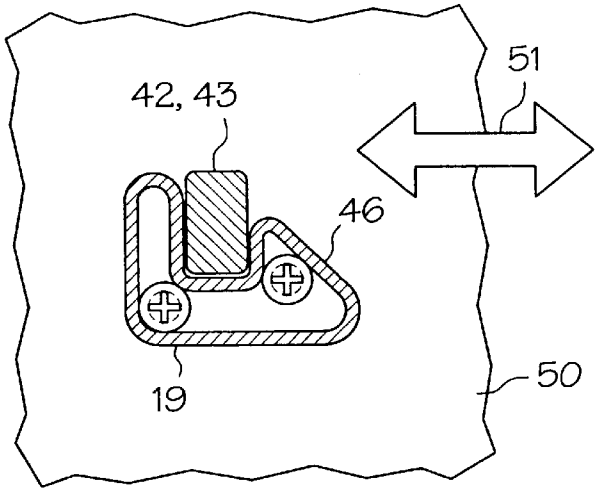
FIG. 8 is a view of a portion of the latch wall and one of the two identical latch receivers that are mounted at vertically spaced locations on the latch wall, this figure including an arrow to show the direction of gate closing relative to the latch receivers.

In an embodiment of the invention, a vertically extending hinge rail 35 at one end 16 of a first gate section 11 is hinged to one wall 44 of an opening (i.e., to the opening's hinge wall 44), and a vertically extending latch rail 37 at the other end 18 of the second gate section 12 is latched to the other wall 50 of the opening (i.e., to the opening's latch wall 50). The gate assembly latch assembly 14 is constructed and arranged such that two latch receives 19 (best seen in FIG. 8), when mounted on latch wall 50, provide that gate assembly 10 can swing, or open, in only one preselected direction. In this way, gate assembly 10 can be prevented from opening, or pivoting over a stairwell into a high traffic area, and the like.

Figure 6:
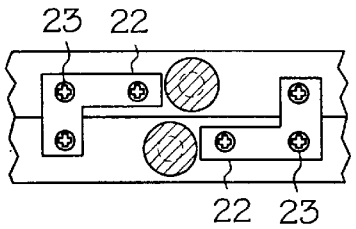
FIG. 6 is a bottom view of a portion of FIG. 4 that shows how two of the four identical L-shaped flat metal plates operates to secure the two bottom rails together, this scheme being identical to that used to secure the two top rails together.
Figure 5:
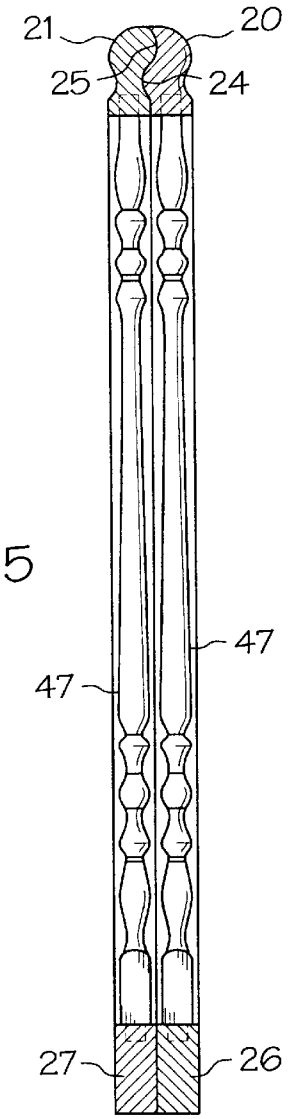
FIG. 5 is a section view of the gate assembly of FIG. 4 taken on the line 5—5, this view showing how the mating inner surfaces of the top rails of the two gate sections are hill and valley shaped in an interlocking manner, and showing how the outer surfaces of the top rails blend to form the shape of a banister.
Figure 3:
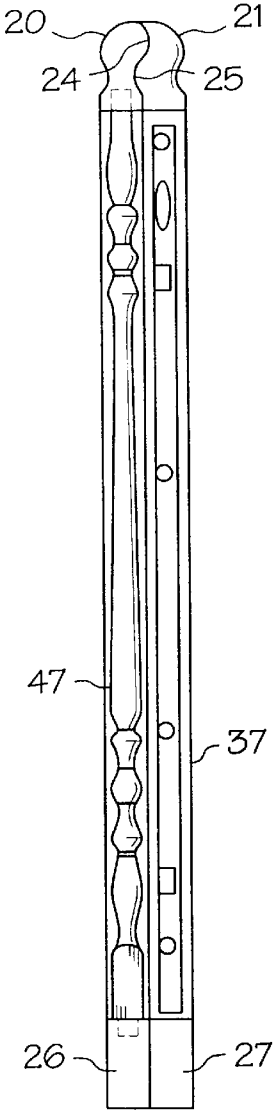
FIG. 3 better shows the latch assembly within the cavity that is formed in the vertical wall side edge of the latch rail shown in FIG. 2.
Figure 4:
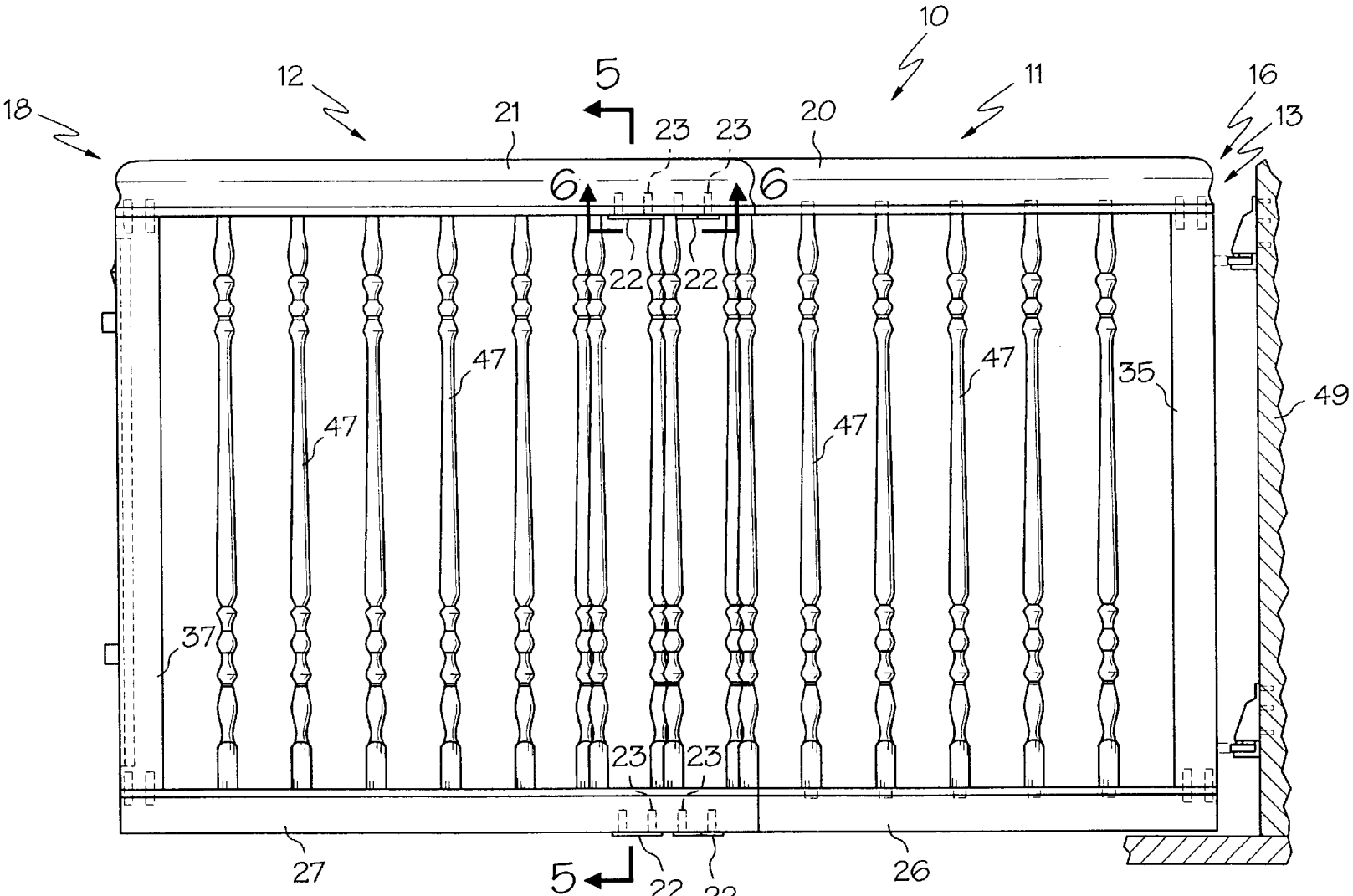
FIG. 4 shows the two gate sections of FIGS. 1 and 2 with their inner surfaces in an abutting, or mating relationship, with the two gate sections overlapped by a user to form a unitary gate assembly of a horizontal length that is user selected to close a given size opening, wherein the user has attached two L-shaped flat metal members, or plates, to the bottom of the two top rails to thereby secure the two top rails together, and wherein the user has attached two L-shaped flat metal plates to the bottom of the two bottom rails to thereby secure the two bottom rails together.

Each of the respective two gate sections 11/12 includes a linear, horizontally extending, aesthetically pleasing, and top disposed top rail half 20/21. These two top rail halves 20/21 are retained closely together in an abutting relationship by way of one or more metal brackets 22 that underlie the overlapping portion of the two top rail halves, and are secured thereto as by way of screws 23. or the like, as best seen in FIG. 6. The generally vertically extending inner and mating surfaces 24/25 of these two top rail halves are horizontally contoured in a pattern of hills and valleys to provide two interlocking and complementary mating surfaces 24/25 that serve to interlock the two top rail halves 20/21 physically together, as best seen in FIGS. 3 and 5. Preferably, the outer surface of the two top rail halves, when so assembled, resemble a well known and aesthetically pleasing banister. Within the spirit and scope of this invention, the assembled two top rail halves may be formed to be compatible with any desired furniture period.

Each of the respective two gate sections 11/12 also include a linear, horizontally extending, aesthetically pleasing, and bottom disposed rail 26/27. Bottom rails 26/27 are also retained closely together by way of one or more metal brackets 22 that underlie the overlapping portion of the two bottom rails, and are secured thereto as by way of screws 23. or the like. The inner and mating inner surfaces of these two bottom rails comprise generally flat horizontal planes.

As shown, the two gate sections 11/12 are completed by the use of a plurality of vertically extending spindles 47. Spindles 47 more generally comprise a gate section closure means 47 that, within the spirit and scope of this invention, can take a variety of forms. For example, spindles 47 can be shaped to coordinate to any desired furniture period.

Figure 7:
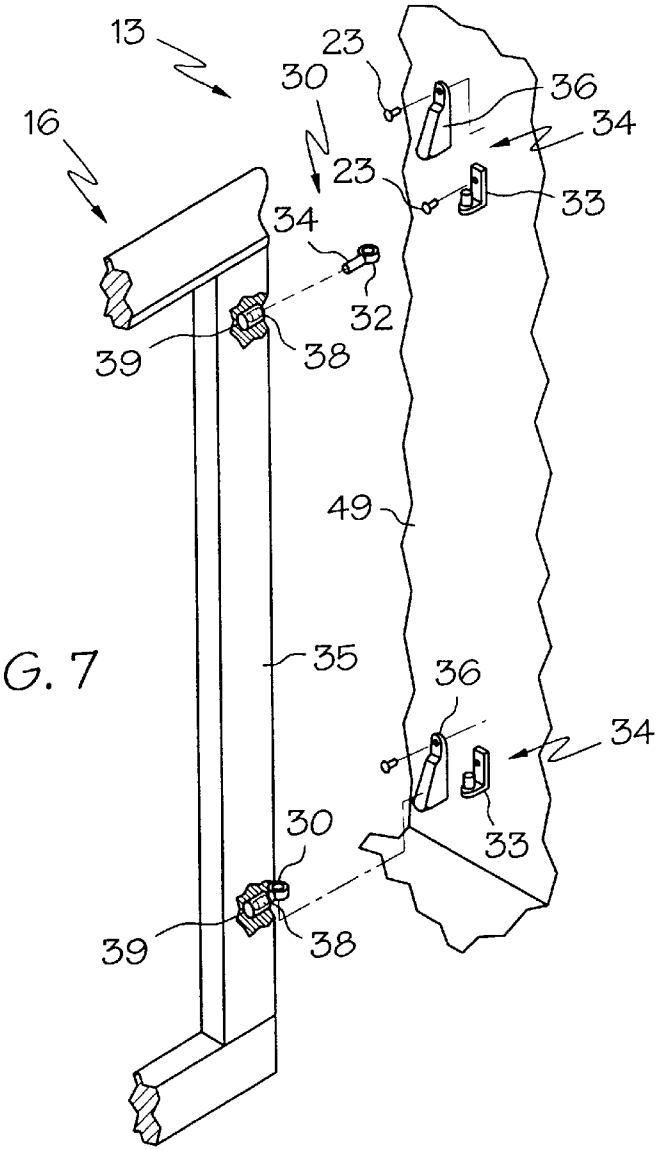
FIG. 7 is an exploded view showing the construction and arrangement of the hinge rail side (i.e., the right side of the gate assembly shown in FIG. 4), this view showing the hinge assembly and a portion of a floor and a hinge wall that form an opening to be closed by the gate assembly of FIG. 4.

A first of the two gate sections, i.e., gate section 11, can be called a hinge gate section 11, since the one end 16 of gate section 11 includes a vertically extending hinge rail 35 that carries two horizontally directed and vertically spaced inserts 38 that each have an internal and horizontally directed bolt thread 39, as best seen in FIG. 7. Each of the two threaded inserts 38 cooperates with the threaded end of a well-known swing bolt 30, or alternatively, a jig latch bolt having bolt threads 31 on one end thereof and having a closed or 360-degree eyelet 32 on the opposite end thereof.

In operation, eyelet 32 of each swing bolt 30 is lowered vertically downward onto the vertically upstanding pivot post 33 of a mating position L-shaped hinge bracket 34 that is mounted onto hinge wall 49. The two pivot posts 33 are vertically aligned so as to define a vertically extending pivot axis for gate assembly 10.

In operation, the user individually twists, or turns, each swing bolt 30 into its mating threaded insert 38 in order to provide a gate assembly 10 whose top rail halves 20/21 are truly horizontal, thus compensating for an adjacent hinge wall being out of plumb.

As a feature of this invention, an aesthetically pleasing hinge cover 36 is provided for each of the two L-shaped hinge brackets 34.

As another feature of this invention, a hinge mounting template (not shown) is provided to the user. This template enables the user to correctly mount the two L-shaped hinge brackets 34 on hinge wall 49 by way of one screw 23 for each L-shaped hinge bracket 34, this usually being the lower one of two screws 23. After the user has properly adjusted the two swing bolts 30, as above described, a second screw 23 is used to secure decorative hinge cover 36, and to additionally secure the hinge bracket 34, to the hinge wall.

Figure 9:
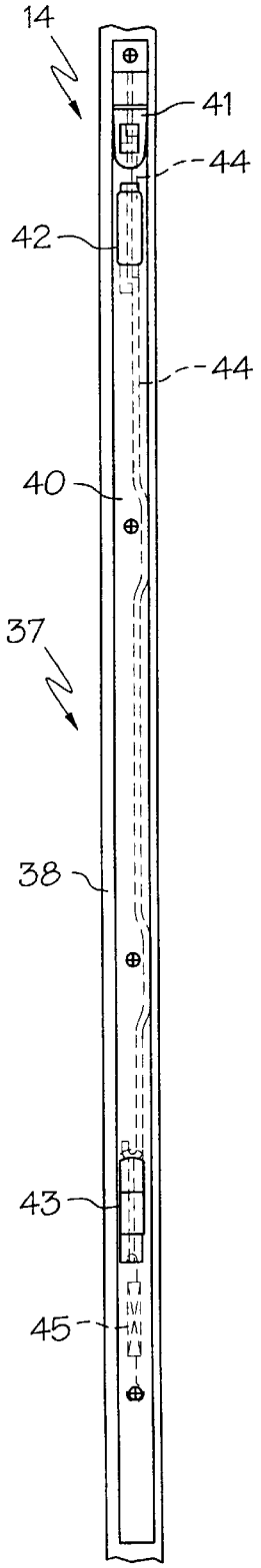
FIG. 9 is a front view of the multi-component latch assembly mounted within the latch cavity shown in FIGS. 2 and 3.
Figure 10:
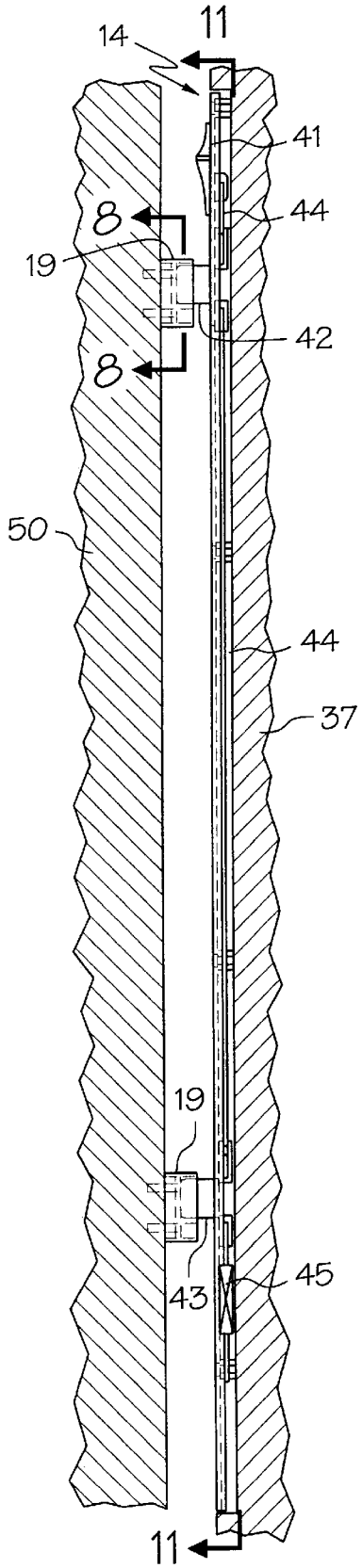
FIG. 10 is a side view of the latch assembly and the latch wall.
Figure 11:
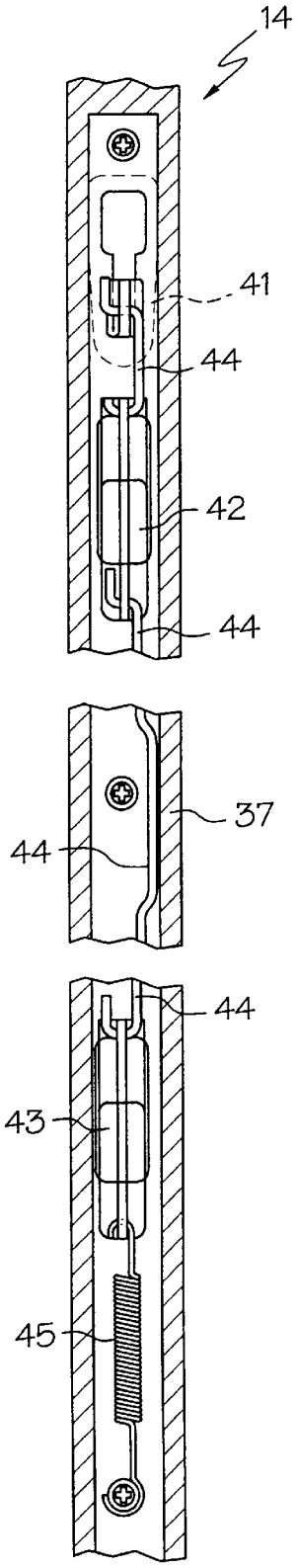
FIG. 11 is an enlarged and partial rear view of the latch assembly whose front view is shown in FIG. 9.

The second of the two gate sections, i.e., gate section 12, can be called a latch gate section 12, since the opposite end 18 of gate section 12 (i.e., the end that is opposite above described hinge rail 35) includes a vertically extending latch rail 37 that internally houses latch assembly 14 in an aesthetically pleasing manner. That is, and as best seen in FIGS. 9–11, the relatively horizontally narrow vertical latch edge 38 of latch rail 37 that faces closely adjacent latch wall 50 is provided with an open face cavity 39 within which the major portion of the operative elements of latch assembly 14 are housed. Latch assembly 14 includes an aesthetically pleasing cover 40 that substantially closes cavity 39, with the exception of an upper disposed, manually operable, and vertically movable latch pull 41, and two vertically spaced and vertically movable latch tabs 42/43 that extend out of openings that are provided in cover 40.

Latch pull 41 and the two latch tabs 42/43 are vertically positioned from one another, with latch pull 41 being on top, with a first latch tab 42 being located thereunder, and with a second latch tab 43 being located under the first latch tab 42. Latch pull 41 and the two latch tabs 42/43 are serially connected together by means of rigid metal links 44, best seen in FIG. 11, such that manually pulling latch pull 41 vertically upward also causes the two latch tabs 42/43 to move upward, to thereby unlatch gate assembly 10 from the two wall mounted latch receivers 19.

The bottom-most element of latch assembly is a bottom disposed extension spring 45 that is connected to the lower most, or bottom, latch tab 43. Extension spring 45 operates to spring bias the assembly that comprises latch pull 41, intermediate positioned latch tab 42, lower most positioned latch tab 43, and metal links 44 to a downward position; i.e., to a gate latched position.

In an embodiment of the invention, all parts of latch assembly 14, exclusive of metal links 44 and extension spring 45, were made of an ABS resin.

Each of the two vertically spaced latch tabs 42/43 horizontally extend outward from the latch assembly decorative cover 40, as best seen in FIG. 10. Each of the two latch tabs 42/43 cooperates with its own wall mounted latch receiver 19. Each latch receiver 19 includes an upward extended slopped surface or ramp 46, best seen in FIG. 8, that is encountered by its latch tab 42/43 as gate assembly 10 is pivoted to close an opening that is formed by the horizontal spacing of hinge wall 49 and latch wall 50, and as gate assembly 10 moves to its latched position. The two sloped surfaces 46 face in the same, or a common direction, and this direction of slope facing determines the manner in which gate assembly 10 is pivoted in order to close and latch gate assembly 10 (see arrow 51 of FIG. 8), or in order to open and unlatch gate assembly 10 (the direction opposite to arrow 51). Merely by reversing this common direction of slope facing, the gate assembly's swing direction can be changed.

As noted above, when it is desired to open gate assembly 10, the user merely pulls upward on latch pull 41, thus pulling the two latch tabs 42/43 vertically upward and out of engagement with the two wall-mounted latch receivers 19.

From the above description, it can be seen that the present invention provides a two section gate assembly 10 that operates to restrict access through a wall opening, wherein the two gate sections 11/12 overlap as determined by the wall opening size, wherein a vertical hinge rail 35 in one gate section forms a hinge side, and wherein a vertical latch rail 37 the other gate section forms a latch side. A concealed vertical edge of hinge rail 35 includes two horizontally spaced swing bolts 30 that are horizontally adjusted to compensate for a hinge wall 49 that is not perpendicular. The two swing bolts 30 and the two wall mounted hinge pins 33 are then covered by hinge covers 40. A concealed vertical edge of latch rail 37 includes two horizontally spaced latch tabs 42/43 that are spring biased downward. Upon swinging gate assembly 10 to a closed position, latch tabs 42/43 encounter wall-mounted latch receivers 19 having upward extending ramps 46, whereupon latch tabs 42/43 are forced to move upward against their spring bias. When gate assembly 10 is fully closed, latch tabs 42/43 drop vertically downward into a latch recess 48. The edge of latch rail 37 also includes an upward movable latch pull 41. Upward movement of latch pull 41 unlatches gate assembly 10 from latch receivers 19. The top rails 20/21 of the two gate sections 11/12 have internally facing surfaces 24/25 with interlocking shapes, and the external surface of the two top rails 20/21 blend to form the shape of a banister.

Figure 12:
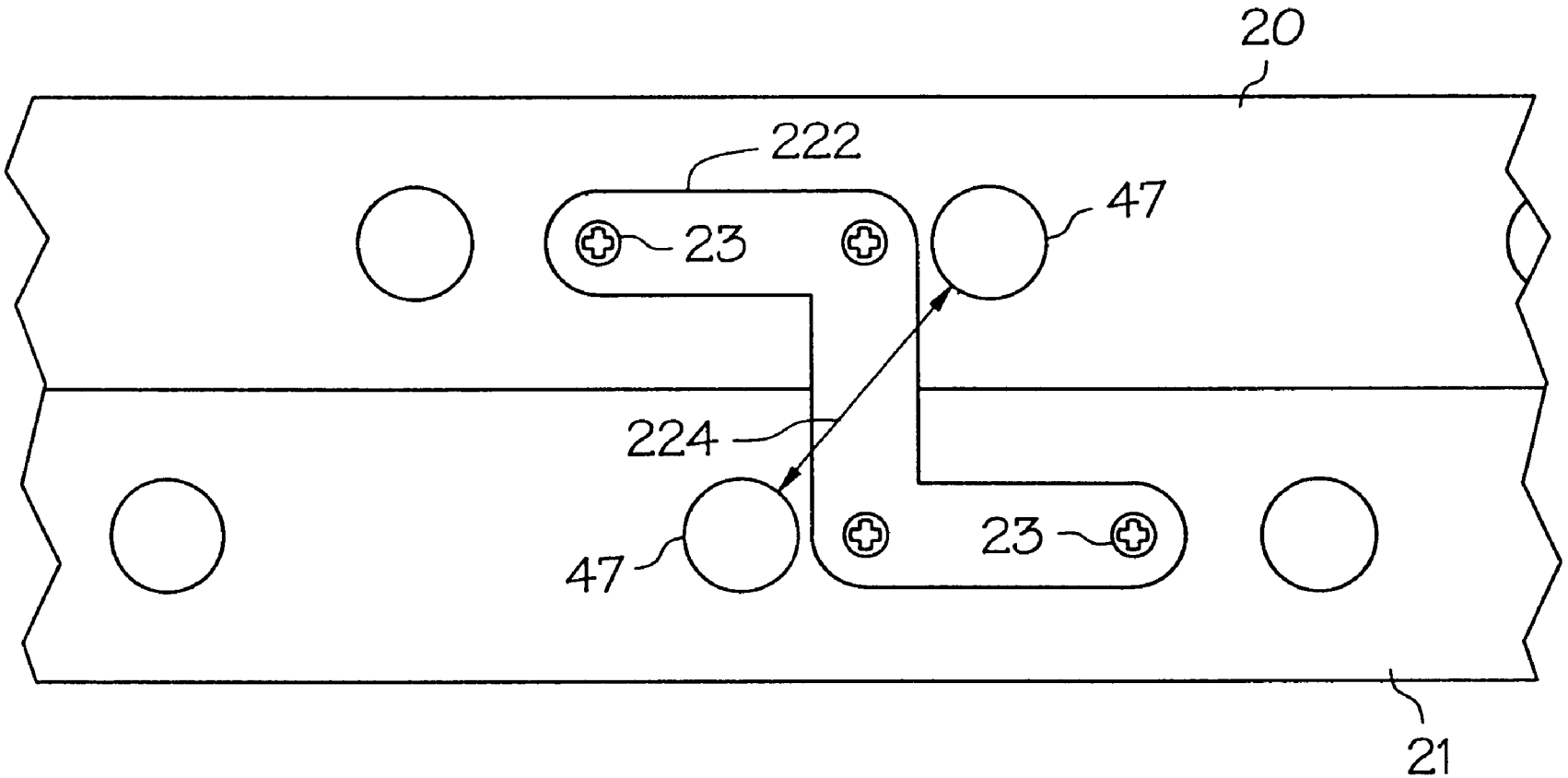
FIG. 12 is a bottom view of portion of FIG. 4 that shows how a modified form of flat metal plate operates to secure the two top-rails together, so as to insure an desirable spacing of about ⅜-inch between the spindles within the two gate-sections.

FIG. 12 shows a feature of the invention that provides safety to the fingers, for example to the fingers of a child. In this figure the bottom surfaces of top-rails 20/21 are secured together by the use of one or more flat, Z-shaped, metal brackets 222. Each such bracket 222 is located so that its diagonal leg 223 extends between two adjacent spindles 47, one spindle being in one gate-section, and the other spindle being in the other gate-section. The width of leg 223 is such that the tangent-to-tangent distance 224 between two such adjacent spindles 47 is about ⅜th inch. Again, screws 23 operate to secure metal bracket 222 to the under side of top-rails 20/21. With this construction and arrangement, a child cannot catch of jam or catch a finger between adjacent spindles 47 that are within the overlapped portion of the gate-assembly.

Since those skilled in the art will, upon learning of this invention as above described in detail, readily visualize yet other embodiments that are within the spirit and scope of this invention, the above detailed description should not be taken as a limitation on the spirit and scope of this invention.

What is claimed is:

1. A walk-through gate-assembly, comprising:

a first gate-section having a first top disposed half rail with a first outer surface and with a first contoured inner-surface that is composed of a first plurality of horizontally directed hills and valleys;

a second gate section having a second top disposed half rail with a second outer surface and with a second contoured inner surface that is composed of a second plurality of horizontally directed hills and valleys;

said first and second outer surfaces blending to form a banister;

said first and second contoured inner surfaces being complementary contoured surfaces that horizontally interlock to stabilize said banister; and means associated with said walk-through gate assembly for mounting said walk-through gate assembly on a wall.

2. The walk-through gate assembly of claim 1 wherein said gate assembly has two oppositely disposed and vertical wall edges, wherein said means includes a latch associated with a first of said vertical wall edges and a pivot associated with a second of said vertical wall edges, and including an adjustable device within said pivot operable to adjust said pivot so as to correct for an associated pivot wall being non-vertical.

3. A walk-through gate assembly, comprising:

a first planar gate section having a vertical hinge rail located at a first vertical edge thereof, and having a second vertical edge horizontally spaced from said first vertical edge;

a second planar gate section having a vertical latch rail located at a corresponding second vertical edge thereof, and having a corresponding first vertical edge horizontally spaced from said second vertical edge;

means associated with said first and said second gate sections for mounting said first and second gate sections together in a planar abutting relationship so that portions thereof containing said second vertical edge of said first gate section and said first vertical edge of said second gate section overlap to an extent that is determined by an opening size that is to be closed by said gate assembly and that is formed by a hinge wall and a latch wall;

a pivot associated within said first vertical edge of said first gate section, said pivot for attachment to the pivot wall;

a cavity within said second vertical edge of said second gate section;

a latch having a first latch portion mounted within said cavity, and having a second vertically movable latch portion extending horizontally outward from said second vertical edge of said second gate section, said first latch portion being physically connected to said second latch portion;

means within said cavity and connected to said first latch portion for force biasing said second latch portion in a vertically downward direction;

a latch receiver for attachment to the latch wall, said latch receiver having a vertically upward directed ramp for physical engagement by said second latch portion, and said vertically upward directed ramp terminating at a vertically downward directed latch recess;

said vertically upward directed ramp for slideably receiving said second latch portion during latching of the gate assembly to the latch wall, and for thereafter latching said second latch portion in said vertically downward directed latch recess; and a manually operable latch pull located above and operatively connected to said first latch portion to selectively move said second latch portion upward in a vertical direction, out of said downward directed latch recess, and against said force bias as the gate assembly is unlatched from the latch wall.

4. The walk-through gate assembly of claim 3 wherein said pivot includes an adjustment member cooperating with said pivot and operable to correct for the pivot wall that is not plumb.

5. The walk-through gate assembly of claim 4 wherein said adjustment member comprises:

a threaded insert within said hinge rail, said threaded insert having a horizontally directed female thread portion; and a linear swing bolt having a male thread end adjustably secured within said female thread portion, and having an eyelet end for attachment to the pivot post.

6. The walk-through gate assembly of claim 5 including:

a cover secured to the pivot wall operable to conceal said swing bolt and the pivot post.

7. In a walk-through gate assembly having a vertically extending hinge rail that is adapted to be hinge mounted on a hinge wall that contains first and second vertically spaced hinge posts that are spaced from each other by a given distance, the improvement comprising:

a first female thread pattern within said hinge rail defining a first horizontal thread axis;

a second female thread pattern within said hinge rail, said second female thread pattern being vertically spaced from said first female thread pattern by the given distance, said second female thread pattern defining a second horizontal thread axis that is parallel to said first horizontal thread axis, said first and second thread axes occupying a common vertical plane;

a first linear swing bolt having a male thread portion adjustably positioned within said first female thread pattern, and having an eyelet adapted to cooperate with the first hinge post; and a second linear swing bolt having a male thread portion adjustably positioned within said second female thread pattern, and having an eyelet adapted to cooperate with the second hinge post;

wherein the first and second linear swing bolts can be adjustably positioned within the respective first and second female thread patterns to different positions relative to each other so that the vertically extending hinge rail can be maintained in a vertical orientation even if the hinge wall to which it is mounted is not planar or is not in a vertical orientation.

8. The apparatus of claim 7, including:

a first cover operative to conceal the first hinge post and the eyelet of said first swing bolt; and a second cover operative to conceal the second hinge post and the eyelet of said second swing bolt.

9. The apparatus of claim 8 wherein said first and second covers are secured to the hinge wall.

10. A hinged and latched gate assembly for use in spanning a horizontal opening size that exists between a hinge wall and a latch wall, comprising:

first and second vertically spaced hinge posts adapted for attachment to the hinge wall, said first and second hinge posts being spaced from each other by a first given distance;

first and second vertically spaced latch receivers adapted for attachment to the latch wall, said first and second latch receivers being spaced from each other by a second given distance;

a first upward-extending ramp on said first latch receiver, said first upward-extending ramp terminating at a first latch recess;

a second upward-extending ramp on said second latch receiver, said second upward-extending ramp terminating at a second latch recess;

said first and second upward-extending ramps facing in a common direction;

a first planar gate section having a first horizontal top rail and a first horizontal bottom rail, having a vertical hinge rail extending between said first top and bottom rails and defining a hinge side, and having a first panel vertically-extending between said first top and bottom rails;

a second planar gate section having a second horizontal top rail and a second horizontal bottom rail, having a vertical latch rail extending between said second top and bottom rails and defining a latch side, and having a second panel vertically-extending between said second top and bottom rails;

means associated with said first and said second gate sections for mounting said first and second gate sections together in a planar abutting relationship so that portions of said first and second panel means overlap to an extent determined by the opening size;

a first female thread pattern within said hinge rail defining a first horizontal thread axis;

a second female thread pattern within said hinge rail, said second female thread pattern being vertically spaced from said first female thread pattern by the first given distance, said second female thread pattern defining a second horizontal thread axis that is parallel to said first horizontal thread axis;

said first and second thread axes occupying a common vertical plane;

a first linear swing bolt having a male thread portion adjustably positioned within said first female thread pattern, and having an eyelet adapted to cooperate with said first hinge post;

a second linear swing bolt having a male thread portion adjustably positioned within said second female thread pattern, and having an eyelet adapted to cooperate with said second hinge post;

a vertically-extending cavity within said latch rail coincident with said latch side;

a vertically-extending cover for said cavity secured to said latch rail;

said cover having a top latch pull opening, a first latch tab opening located below said latch pull opening, and a second latch tab opening located below said first latch tab opening by said second given distance;

a vertically movable and manually operable latch pull within said cavity and extending outward through said latch pull opening;

a first vertically movable latch tab within said cavity and extending outward through said first latch tab opening for cooperation with said first latch receiver;

a second vertically movable latch tab within said cavity and extending outward through said second latch tab opening for cooperation with said second latch receiver;

a rigid link within said cavity interconnecting said latch pull, said first latch tab, and said second latch tab to thereby form a latch assembly; and a spring within said cavity connected to said latch assembly operable to force bias said rigid link, said latch pull, said first latch tab, and said second latch tab vertically downward.

11. The gate assembly of claim 10 including:

a first cover operative to conceal said first hinge post and said eyelet of said first swing bolt; and a second cover operative to conceal said second hinge post and said eyelet of said second swing bolt.

12. The gate assembly of claim 10 wherein:

said first horizontal top rail comprises a first top disposed half rail having a first outer surface and having a first contoured inner surface that is composed of a first plurality of horizontally directed hills and valleys;

said second horizontal top rail comprises a second top disposed half rail having a second outer surface and having a second contoured inner surface that is composed of a second plurality of horizontally directed hills and valleys;

said first and second outer surfaces blending to form a banister; and said first and second contoured inner surfaces being complementary contoured surfaces that horizontally interlock to stabilize said banister.

13. The gate assembly of claim 12 including:

a first cover operative to conceal said first hinge post and said eyelet of said first swing bolt; and a second cover operative to conceal said second hinge post and said eyelet of said second swing bolt.

14. The gate assembly of claim 13 wherein said first and second panels each comprise a like plurality of similarly shaped and vertically extending spindles.

15. A walk-through gate assembly for spanning an opening formed by generally-vertical first and second opposed surfaces, comprising:

first and second gate pieces, the first gate piece being adapted for pivotal connection to the first opposed surface, the second gate piece being adapted for latching engagement with the second opposed surface, the second gate piece having a vertically-extending cavity therein;

an attachment bracket for removably affixing the first and second gate pieces together;

at least one pivot pin adapted for attachment to the first opposed surface;

at least one hinge member affixable to the first gate piece and pivotably engageable with the at least one pivot pin;

a latch assembly received within the vertically-extending cavity in the second gate piece, the latch assembly having at least one latch finger extending from the cavity toward the second opposed surface, the latch assembly being resiliently biased downward, and the latch assembly having a latch actuator operatively connected to and located above the latch finger; and a latch receptacle adapted for attachment to the second opposed surface, the latch receptacle being receptive of the latch finger when the gate asseembly is pivoted in a first direction toward the second opposed surface to a position where the latch finger contacts the latch receptacle.

16. A gate assembly as defined in claim 15, wherein the latch receptacle includes a diagonal ramp portion and a notch portion adjacent thereto, the ramp portion having a slope and a height suitable to raise the latch assembly against the resilient bias, the notch portion being suitably sized to receive the latch finger therein once the gate assembly has been sufficiently pivoted until the latch finger passes over the ramp portion, the notch portion having a side wall on an opposite side from the ramp portion to substantially prevent the gate assembly from pivoting further in the first direction.

17. A gate assembly as defined in claim 15, wherein there are two hinge members, the hinge members including an eyebolt that can be screwed into the first gate piece a suitable distance so that the gate assembly will pivot in a horizontal plane even if the first opposed member is not planar or is not vertical.

18. A gate assembly as defined in claim 15, wherein there are two pivot pins, two hinge members, two latch fingers, and two latch receptacles.

19. A gate assembly as defined in claim 15, wherein the first and second gate pieces have mating top rails, outer surfaces of the mating top rails being shaped to form a banister, inner opposed surfaces of the mating top rails being shaped to have mating, horizontally-directed hills and valleys.

* * * * *